United States Patent [19]

Lasker et al.

[11] Patent Number: 4,713,737

[45] Date of Patent: Dec. 15, 1987

[54] ELECTRICAL LIGHTING FIXTURE WITH MULTIPLE ROTATION MECHANISM

[75] Inventors: Martin L. Lasker, Edison, N.J.; Joel S. Cohen, Oakland, Calif.

[73] Assignee: Prescolite Inc., San Leandro, Calif.

[21] Appl. No.: 848,634

[22] Filed: Apr. 7, 1986

[51] Int. Cl.[4] ..... F21V 21/28

[52] U.S. Cl. ..... 362/285; 362/419; 362/365

[58] Field of Search ..... 362/33, 74, 285, 287, 362/372, 418, 419, 365, 864, 362

[56] References Cited

U.S. PATENT DOCUMENTS

| | | | |
|---|---|---|---|
| 2,161,183 | 1/1938 | Mastney | 74/10 |
| 2,863,330 | 12/1958 | Moorehead | 74/526 |
| 3,247,732 | 4/1966 | Barnhart | 74/89 |
| 3,803,400 | 4/1974 | Ozawa | 362/372 |
| 4,090,210 | 5/1978 | Wehling et al. | 362/419 |
| 4,419,721 | 12/1983 | Gregoire et al. | 362/285 |
| 4,605,995 | 8/1986 | Pike | 362/432 |

FOREIGN PATENT DOCUMENTS

| | | | |
|---|---|---|---|
| 547770 | 10/1957 | Canada | 362/365 |
| 3243709 | 5/1984 | Fed. Rep. of Germany | 362/33 |
| 1091160 | 10/1954 | France | 362/33 |

*Primary Examiner*—Charles J. Myhre
*Assistant Examiner*—D. M. Cox
*Attorney, Agent, or Firm*—Bielen and Peterson

[57] ABSTRACT

A lighting fixture mechanically connected to an object utilizing a lamp supporting body. The lamp supporting body is rotated about an axis and includes a swivel member having a swivel arm which moves over the exterior of the lamp supporting body. A boss mechanically connected to the object extends outwardly from the swivel arm and is supported for movement with the swivel arm. A lamp is also supported to the lamp supporting body and is electrically connected to a source of electrical power.

11 Claims, 7 Drawing Figures

FIG. 4
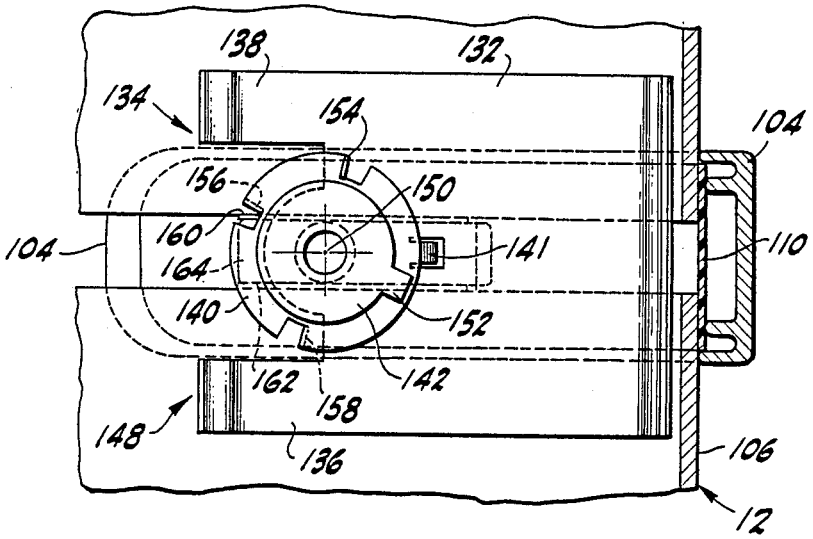
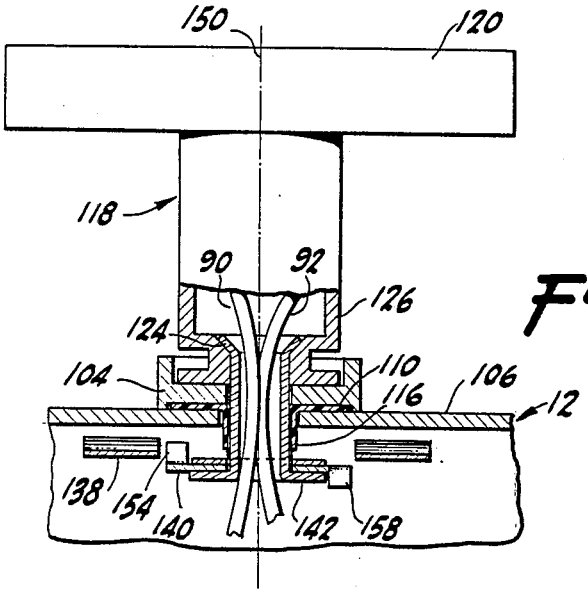
FIG. 5
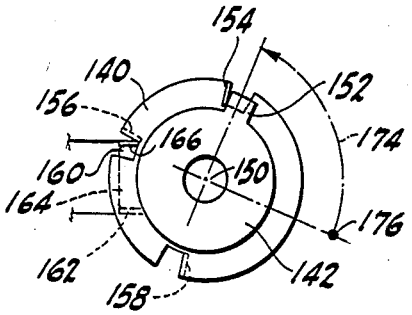
FIG. 6
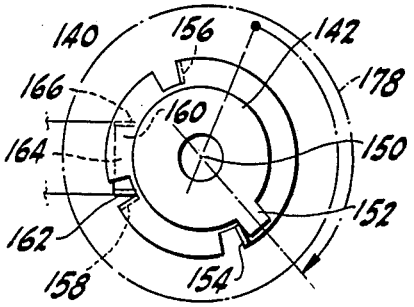
FIG. 7

ELECTRICAL LIGHTING FIXTURE WITH MULTIPLE ROTATION MECHANISM

BACKGROUND OF THE INVENTION

The present invention relates to a novel lighting fixture having multiple rotation mechanisms.

Light fixtures are often required to direct light to various areas and at various angles in order to be versatile or useful. This criteria is especially acute in track lighting fixtures which are typically mounted from a ceiling or wall above the space to be illuminated.

One type of adjustable lighting fixture may be seen in a surface mounted lamp distributed under the trademark Accent One by Gardco Lighting of San Leandro, Calif. The Gardco Lighting fixture is not able to move along a track since it is enclosed in a tubular support.

A lighting fixture generally cylindrical in shape having adjustability about several axes would be a notable advance in the art of lighting.

SUMMARY OF THE INVENTION

In accordance with the present invention a novel and useful lighting fixture having multiple rotational adjustment mechanism is provided.

The lighting fixture of the present invention is mechanically connected to an object and electrically connected to a source of electrical power. The fixture is constructed with a lamp supporting body having exterior and interior portions. The body may be patterned on a solid geometrical shape and be aligned along an axis.

The invention also encompasses means for rotating the lamp supporting body about a first axis. The rotating means includes a swivel member having a swivel arm which moves over the exterior of the lamp supporting body. A boss extends outwardly from the swivel arm and is mechanically connected to the object. The boss may also extend through a slot in the lamp supporting body and be held thereto such that the lamp supporting body and the boss rotate relative to one another. Means is also provided for supporting the boss for movement with the swivel arm over the exterior of the lamp supporting body. An electrical lamp is also held to the lamp supporting body and is electrically connected to a source of electrical power.

The swivel arm receives lubrication from appropriate means to permit the movement of the swivel arm over the exterior of the lamp supporting body. Such means for lubricating the swivel arm relative to the lamp supporting body may take the form of a pad having a slip surface. The pad contacts the exterior of the lamp supporting body and the swivel arm, since it is interposed these two elements. The pad may move with the swivel member over the exterior of lamp supporting body and be supported to the swivel arm for such movement.

The lighting fixture of the present invention may also possess means for rotating lamp supporting body about a second axis. Such rotation would occur relative to the boss. Rotation about the second axis may encompass an arc of greater than 360°. Means for accomplishing such rotation may include placing a stop on the boss. In addition, a washer is provided having a first stop which is capable of contacting the stop of the boss. Second and third stops are also provided on the washer for contact with a stop on a spring clamp which frictionally engages the lamp supporting body. The washer is rotatable with the boss at times and relative to the boss when the second or third stops of the washer contact the first or second stops of the clamp. Needless to say, the washer is rotatable relative to the clamp. The clamp slidingly engages the lamp supporting body and is moveable from the boss relative to the first axis in certain embodiments of the invention. The clamp may also be constructed of resilient material to serve as a holding mechanism for the boss and washer in relation to the lamp supporting body.

In certain cases, the boss extends to the interior of the lamp supporting body and possesses an end portion having a flare. The washer and clamp may be interposed the flare of the boss and the lamp supporting body.

It may be apparent that a novel and useful lighting fixture has been described.

It is therefore an object of the present invention to provide a lighting fixture mechanically connected to an object and electrically connected to a source of electrical power which is adjustable in relation to multiple axes.

It is another object of the present invention to provide a lighting fixture which possesses a lamp supporting body aligned along an axis and includes means for rotating the lamp supporting body about that axis and other axis which intersect that axis.

Another object of the present invention is to provide a lighting fixture which is adaptable to a track lighting system and which is capable of projecting light over a large area without disrupting the axial relation between the lighting fixture lamp supporting body and the axes of the track.

The invention possesses other objects and advantages especially as concerns particular characteristics and features thereof which will become apparent as the specification continues.

BRIEF DESCRIPTION OF THE DRAWINGS

FIG. 4 is a sectional view taken along line 4—4 of FIG. 3 depicting a rotational mechanism of the present invention.

FIG. 5 is a view taken along line 5—5 of FIG. 3.

FIG. 6 is a plan view of the rotational mechanism depicted in FIG. 4 showing the relative rotation of the elements thereof.

FIG. 7 is a plan view of the rotational mechanism depicted in FIG. 4 showing the relative rotation of various elements thereof.

For a better understanding of the application reference is made to the following detailed description of the preferred embodiments thereof which should be taken in conjunction with the hereinabove described drawings.

DESCRIPTION OF THE PREFERRED EMBODIMENTS

Various aspects of the preferred present invention will evolve from the following detailed description of the preferred embodiments which should be referenced to the previously described drawings.

Figure 3:
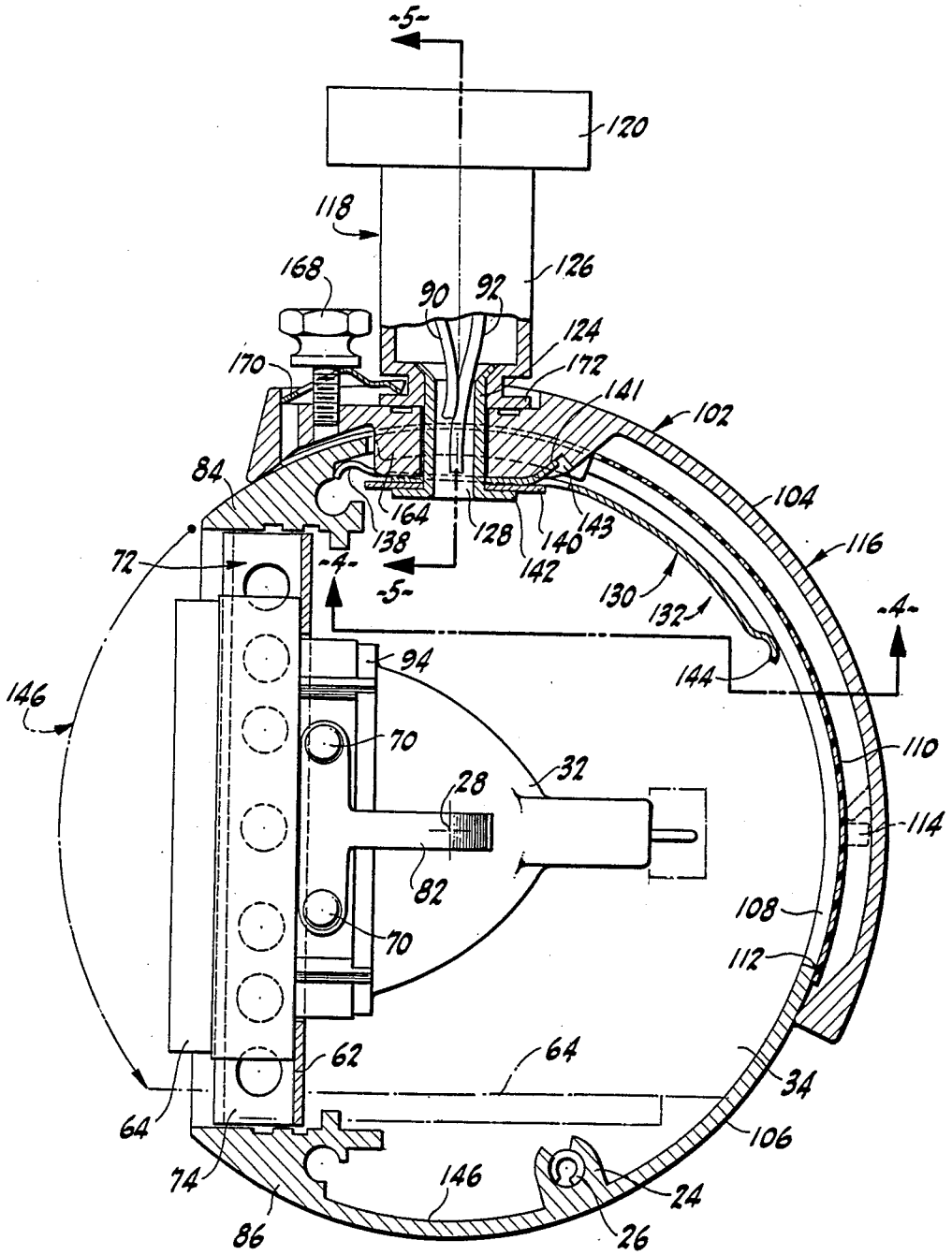
FIG. 3 is a sectional view taken along line 3—3 of FIG. 1.

The invention as a whole is shown in the drawings by reference character 10. Lighting fixture 10 includes as one of its elements a lamp supporting body 12 constructed of a cylindrical center section 14 and a pair of end caps 16 and 18. Center section 14 rests on flanges 20 and 22 of end cap 16 and 18 respectively. With reference to FIG. 3, a fitting 24 encloses wall pin 26 which extends into end cap 18 and a similar fitting (not shown). End cap 16 is held to the other end of center section 12 in similar manner.

Figure 2:
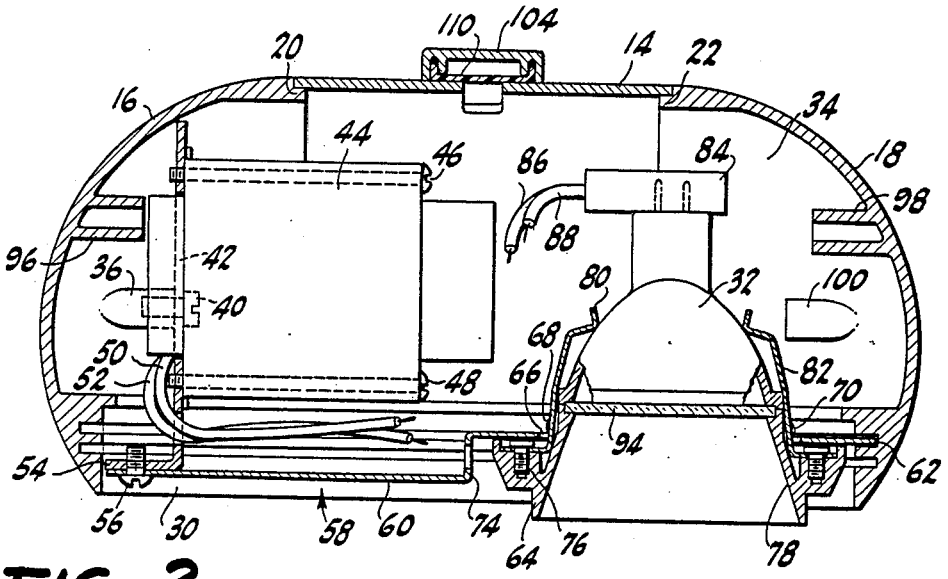
FIG. 2 is a sectional view taken along line 2—2 of FIG. 1.
Figure 1:
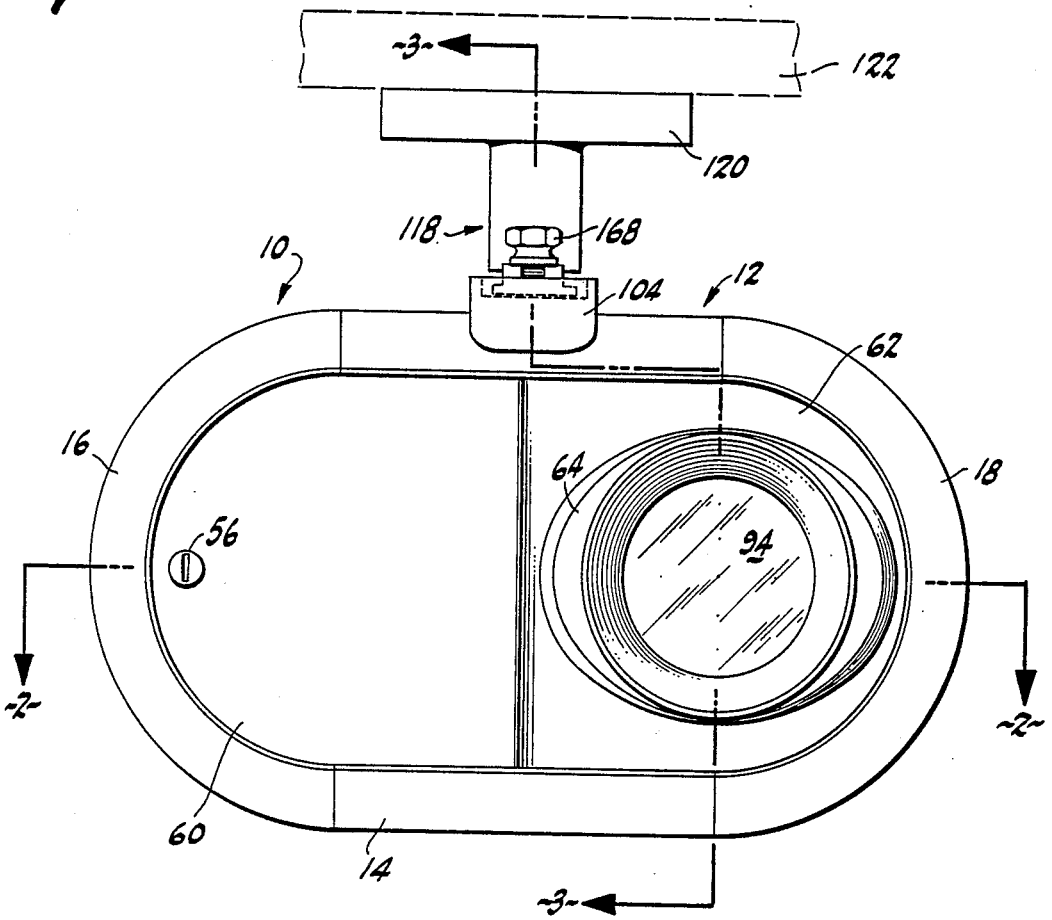
FIG. 1 is a front elevational view of the lighting fixture of the present application.

Lamp supporting body 12 lies on axis 28 which is also the axis of cylindrical center section 14. With reference to FIG. 2 it may be seen that lamp supporting body 12 includes an opening 30 which is roughly oval in configuration. Opening 30 permits light to emanate from lamp 32 held within interior 34 of lamp supporting body 12. Studs 36 and 36 are molded to end caps 16 and 18 respectively. Stud 36 is employed in the embodiment shown in the drawings to accept screw 40 which holds L-shape plate in position. A transformer 44 is mounted to plate 42 by machine screws 46 and 48. Electrical conductors 50 and 52 represent the leads to transformer 44.

Leg 54 of L-shaped plate 42 serves as a base for set screw 56 which holds cover plate 58 in place within opening 30 of lamp supporting body 12. Cover plate 58 is stepped from a blank portion 60 to a recessed portion 62 which serves as a mounting support for baffle cone 64. Baffle cone 64 is press fitted into an opening 66 through portion 62 of cover plate 68. Protrusions such as protrusions 66 and 70, shown in FIG. 2, permit baffle cone 64 to snap fit into openings 66. Plurality of openings 72, best shown in FIG. 3, through transition section 74 of cover plate 68 permit convection dissipation of any heat generated within interior 34 of lamp supporting body 12.

Set screws 76 and 78 hold spring members 80 and 82 to baffle cone 64, FIG. 2. Ledges 84 and 86 which are molded into lamp supporting body 12 generally guide cover plate 58 and baffle cone 64 supported thereto. Lamp 32 plugs into socket 84 having electrical leads 86 and 88, FIGS. 2 and 3. Electrical leads 50, 52, 86, and 88 would be electrically connected in a conventional manner and extend to a source of power (not shown) through leads 90 and 92, FIG. 3. A lens 94, which may be formed of glass or plastic, lies between lamp 32 and baffle cone 64. Spring members 80 and 82 hold lamp 32 and lens 94 in this configuration. It should be noted that studs 96, 98, and 100 are formed for manufacturing expedient such that end caps 16 and 18 are interchangeable with cylindrical center section of lamp supporting body.

The present invention also includes means 102 for rotating lamp supporting body 12 about axis 28. Means 102 utilizes swivel member or arm 104 which moves over the exterior surface 106 of lamp supporting body 12. With reference to FIG. 3 it may be seen that a slot 108 guides swivel arm 104 when lamp supporting body 12 is rotated about axis 28. A pad 110, formed of plastic material such as teflon, includes a slip surface 112 which directly contacts the exterior surface 106 of lamp supporting body 12. As will be hereinafter described, pad 110 moves with swivel member 104. Tab 114 maintains pad 110 in position between swivel member 104 and lamp supporting body 112. Thus, the above described combination serves as means 116 for lubricating the swivel arm 104 in relation to the exterior of 106 of lamp supporting body 12.

Means 102 for rotating lamp supporting body 12 about axis 28 also includes a boss 118 which terminates in a track adaptor 120, mechanically and electrically attached to lighting track 122. Boss 118 is formed of a flare bushing 124 which is fixed to tube 126, adjacent and connected to track adapter 120.

Bushing 124 includes an opening which extends through the same into the interior 34 of lamp supporting body 12. Opening 128 serves as a conduit for leads 90 and 92, heretofore described.

Means 130 supports boss 118 for movement with swivel arm 104 over the exterior surface 106 of lamp supporting body 12. Means 130 includes a spring clamp 132 having a split end portion 134, which includes spring legs 136 and 138. Stop washer 140 interposes spring flange 132 and the flanged end portion 142 of flare bushing 124. The surface of the curved end 144 of spring clamp 132, opposite split end 134 thereof, contacts the interior surface 146 of center section 114, as does legs 136 and 138. Since spring clamp 132 is resilient, the bending of the clamp 132 as shown in FIG. 3 holds flare bushing 124 and stop washer 140 in place. Tab 141 of spring clamp 132 extends into recess 143 to stabilize spring clamp 132 during its movement with swivel arm 104. Thus, swivel member 104 and the upper portion of boss 118 are supported to lamp supporting body 12. Swivel member 104, boss 118 (including flare bushing 124), stop washer 140 and pad 110 rotate relative to lamp supporting body 12 about axis 28. Directional arrow 146, FIG. 3, depicts the movement of lamp supporting body 12 in relation to boss 118. The edge of baffle cone 64 is depicted in phantom at approximately right angles to its positive position shown in the drawings.

Lighting fixture 10 may also include means 148 for rotating boss 118 relative to lamp supporting body 12 about axis 150, FIGS. 4–7 in particular. Means 148 in the embodiment depicted in the drawings permits lamps supporting body 12 to rotate through greater than 360° of arc about axis 150. Flare bushing 124, possesses a stop 152 which contacts the first stop 154 of stop washer 140. Stop washer 140 also possesses second and third stops 156 and 158 which extend in the opposite direction from stop 154. Stops 156 and 158 of stop washer 140 contact edges 160 and 162 of tab 164 extending from swivel member 104. It should be noted, that a portion 166 of pad 110 extends along edges 160 and 162 of tab 164 to cushion the contact with stops 156 and 158 of stop washer 140, FIGS. 6 and 7.

Thumb screw 168 threadingly engages swivel member 104 and presses clip 170 into groove 172 of tube 126. The tightening of thumb screw 168 would control the ease of rotation of boss 118 about axis 150 and the relative rotation of swivel member 104 to lamp supporting body 12, FIG. 3.

In operation, the user places track adapter 120 in lighting track 122 to mechanically and electrically support lighting fixture 10. Thumb screw 168 is loosened to permit the relative rotation of swivel member 104, pad 110, boss 118, and clamp 132 in relation to lamp supporting body 12, more specifically center section 14 thereof. When lamp supporting body 12 rotates about axis 28 according to directional arrow 146 light is directed from lamp 32 outwardly and downwardly as desired. In addition, lamp supporting body 12 may be rotated about axis 150 relative to boss 118. With reference to FIGS. 6 and 7 it may be seen that directional arrow 174 depicts the extreme movement of boss 118 about axis 150 in a counter clockwise direction from a point 176. Stop 152 of bushing 124 contacts stop 154 of stop washer 154. Stop 156 of stop washer 140 can only move as far as the edge 160 of tab 164 in this direction. Directional arrow 178, FIG. 7 shows the ultimate movement in the clockwise direction where tab 152 has contacted the other side of stop 154 of stop washer 140. Stop washer moves only as far as edge portion 162 of tab 164. Thus, from the position shown in FIG. 6 to the position to the position shown in FIG. 7, stop 152 of flare bushing 124 has moved greater than 360°. Specifically, stop 152 has moved 360° plus the arcuate distance between stop 158 of stop washer 140 and edge 162 of tab 164.

While in the foregoing embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. A lighting fixture mechanically connected to an object and electrically connected to a source of electrical power comprising:

a. a lamp supporting body having an exterior and an interior thereto;

b. means for rotating said lamp supporting body about a first axis, said rotating means comprising;

a swivel member including a swivel arm which moves over said exterior of said lamp supporting body;

a boss extending upwardly from said swivel arm, said boss being mechanically connected to the object;

means for supporting said boss for movement with said swivel arm over said exterior of said lamp supporting body;

c. means for supporting the lamp to the lamp supporting body, said lamp being connected to the sorce of electrical power;

d. means for rotating said boss relative to said lamp supporting body held thereto about a second axis, greater than three hundred sixty degrees of arc about said second axis, including:

said boss having a portion including a stop;

a rotatable washer having a first stop which is capable of contacting said stop of said boss and having second and third stops; and a clamp which contacts said lamp supporting body, said clamp including first and second stops which contact said second and third stops of said washer, said clamp holding said swivel member and supported boss to said lamp supporting body.

2. The lighting fixture of claim 1 in which said clamp slidingly engages said lamp supporting body and is movable with said boss relative to said first axis.

3. The lighting fixture of claim 2 in which said clamp is constructed of resilient material.

4. A lighting fixture mechanically connected to an object and electrically connected to a source of electrical power comprising:

a. a lamp supporting body having an exterior and an interior thereto;

b. means for rotating said lamp supporting body about an axis, and rotating means comprising;

a swivel member including a swivel arm which moves over said exterior of said lamp supporting body;

a boss extending upwardly from said swivel arm, said boss being mechanically connected to the object;

means for supporting said boss for movement with said swivel arm over said exterior of said lamp supporting body;

c. means for supporting the lamp to the lamp supporting body, said lamp being connected to the source of electrical power; and d. means for lubricating said swivel member in relation to said exterior of said lamp supporting body.

5. The lighting fixture of claim 4 in which said means for lubricating said swivel member in relation to said exterior of said lamp supporting body includes a pad having a slip surface which contacts said exterior surface of said lamp supporting body said pad being interposed said exterior of said lamp supporting body and said swivel member.

6. The lighting fixture of claim 5 in which said pad moves with said swivel member over said exterior surface of said lamp supporting body.

7. A lighting fixture mechanically connected to an object and electrically connected to a source of electrical power comprising:

a. a lamp supporting body having an exterior and an interior thereto said lamp supporting body including a slot;

b. means for rotating said lamp supporting body about an axis, said rotating means comprising;

a swivel member including a swivel arm which moves over said exterior of said lamp supporting body;

a boss extending upwardly from said swivel arm, said boss being mechanically connected to the object, said boss extending to the interior of said lamp supporting body through said slot of said lamp supporting body;

means for supporting said boss for movement with said swivel arm over said exterior of said lamp supporting body;

c. means for supporting the lamp to the lamp supporting body, said lamp being connected to the source of electrical power.

8. A lighting fixture mechanically connected to an object and electrically connected to a source of power comprising:

a. a lamp supporting body having an exterior and an interior thereto;

b. means for rotating said lamp supporting body about an axis through greater than three hundred sixty degrees of arc including;

a boss mechanically connected to the object and rotatably connected to said lamp supporting body relative to said axis said boss including a portion having a stop;

a washer having a first stop which is capable of contacting said boss stop and having second and third stops; and a clamp contacting said lamp supporting body, said clamp including first and second stops which contact said second and third stops of said washer, said clamp holding said swivel arm and supported boss to said lamp supporting body.

9. The lighting fixture of claim 8 in which said washer rotates relative to said axis.

10. The lighting fixture of claim 9 in which said boss includes an end portion which extends to the interior of lamp supporting body, said end portion including a flare said washer and clamp being interposed said flare of said boss end portion and said lamp supporting body.

11. The lighting fixture of claim 10 in which said clamp is constructed of resilient material, said clamp urging said washer and flare of said boss end portion from said lamp supporting body.

* * * * *